US005263411A

United States Patent [19]

Gourdol

[11] Patent Number: 5,263,411

[45] Date of Patent: Nov. 23, 1993

[54] PRESS FOR COMPACTING AND FOR TREATMENT OF WASTE

[75] Inventor: Jacques Gourdol, Varces-Alliers-Risset, France

[73] Assignee: Neyrpic Framatome Mecanique, Courbevoie, France

[21] Appl. No.: 819,125

[22] Filed: Jan. 10, 1992

[30] Foreign Application Priority Data

Jan. 10, 1991 [FR] France ..... 91 00248

[51] Int. Cl.[5] ..... B30B 9/06

[52] U.S. Cl. ..... 100/98 R; 100/127; 100/218; 100/232; 100/249; 100/251

[58] Field of Search ..... 100/98 R, 126, 124, 100/130, 179, 249, 251, 218, 131, 188 R, 232, 95

[56] References Cited

U.S. PATENT DOCUMENTS

| | | | |
|---|---|---|---|
| 2,705,916 | 4/1955 | Millgard | 100/251 |
| 3,070,003 | 12/1962 | Stacy | 100/251 |
| 3,962,968 | 6/1976 | Tribbett et al. | 100/249 |
| 3,980,014 | 9/1976 | McEwen et al. | 100/127 |
| 4,346,653 | 8/1982 | Rodak | 100/249 |
| 4,421,022 | 12/1983 | Burgin | 100/98 R |
| 4,557,190 | 12/1985 | Vezzani | 100/249 |
| 4,590,000 | 5/1986 | Baatz et al. | 100/249 |
| 4,630,535 | 12/1986 | Haygreen | 100/127 |
| 4,665,817 | 5/1987 | Simpson | 100/98 R |

FOREIGN PATENT DOCUMENTS 2510471 12/1983 France .

*Primary Examiner*—Harvey C. Hornsby
*Assistant Examiner*—Reginald L. Alexander
*Attorney, Agent, or Firm*—Pollock, Vande Sande & Priddy

[57] ABSTRACT

The press comprises a frame (1), a feed zone (3) receiving the waste to be treated, a pressing chamber (9) comprising an intake aperture (10) and an outlet aperture (11) and a chamber (14) for discharging the solid phase. The press also comprises a component (15) movable transversely relative to the axis of the pressing chamber (9) between a first position for closing off the outlet aperture (11) and a second position for opening the outlet aperture (11), comprising jacks (20) for horizontal movement of the movable component in the direction of the axis of the pressing chamber (9) in order to apply the face of the movable component facing the outlet aperture (11) against the outlet aperture during compression of the heterogeneous waste.

9 Claims, 8 Drawing Sheets

PRESS FOR COMPACTING AND FOR TREATMENT OF WASTE

FIELD OF THE INVENTION

The subject of the present inventions is a press for compacting and for treatment of heterogeneous waste.

BACKGROUND OF THE INVENTION

For several years, the growing volume of waste and in particular of household refuse has made it essential to seek solutions enabling this waste to be treated and utilized.

The use of such waste as fuel has already been thought of, but the presence in the latter of a high water content and of incombustible materials permits production only of insufficient energy.

In fact, such waste is constituted by a liquid phase containing only organic products and by a solid phase containing metallic, mineral and synthetic materials.

One solution consists in compacting the waste, and this makes it possible to obtain both residues dry enough to constitute a fuel offering an acceptable calorific power, and fluid substances which can be used, depending on their nature, in agriculture as soil improvement products or as raw materials from which chemical products can be extracted.

Devices are known already which make it possible to compress waste, which are generally constituted by hydraulic presses comprising a feed zone receiving the waste to be treated, a pressing chamber connected to means for recovery of the liquid phase and a chamber for discharge of the solid phase, situated downstream of the pressing chamber.

The pressing chamber comprises an intake aperture and an outlet aperture, and has a cross-section equal to that of a piston of a first jack.

The wall of the chamber comprises a multitude of perforations opening into a channel for discharging the liquid phase extracted by compression of the waste.

The outlet aperture of the pressing chamber is generally closed off by a plug carried by a rod of a second jack opposed to the first.

The pistons of the two jacks are movable alternately between a first position for compressing the waste and for discharging the liquid phase, during which the piston of the first jack enters the pressing chamber and the piston of the second jack seals the outlet aperture of said chamber, and a second position for discharge of the solid phase, during which the piston of the first jack continues its stroke and the piston of the second jack frees the outlet aperture of the pressing chamber.

However, presses of this type have disadvantages and in particular pose problems in maintaining leaktightness between the pressing chamber and the chamber for discharging the solid phase.

In fact, taking into account the substantial stresses generated at the moment of pressing of the waste, leaktightness is not totally provided at the level of the outlet aperture of the pressing chamber by the piston of the second jack, with the result that leaks of liquid may occur and enter the chamber for discharging the solid phase.

Moreover, the stroke of the piston of the second jack is relatively long. It corresponds to one thickness of the solid phase, i.e., for an imcompressible product, the equivalent of the length of the die, and this therefore necessitates a large oil capacity in order to actuate the jack. Taking this stroke into account, the response time of the second jack is relatively long and this does not enable high speeds to be obtained.

SUMMARY OF THE INVENTION

The object of the present invention is to avoid these disadvantages and to provide a press which is simple to construct and attains higher speeds than prior art presses.

The subject of the present invention is therefore a press for compacting and for treatment of heterogeneous waste comprising a solid phase and a liquid phase, the press comprising:

a frame, a feed zone receiving the heterogeneous waste to be treated, open towards the top and having two opposed lateral openings with a cross-section adapted to that of a piston movable between one of the openings of the feed zone and a position situated beyond the other opening of the feed zone, a pressing chamber comprising an intake aperture and an outlet aperture, opposed and arranged coaxially with respect to the feed zone, the pressing chamber having a cross-section equal to that of the compression piston and comprising calibrated passages connecting the pressing chamber to means for recovery of the liquid phase, and a chamber for discharging the solid phase, situated downstream of the pressing chamber, comprises a component movable transversaly with respect to the axis of the pressing chamber between a first position for closing off the outlet aperture of the pressing chamber, during the compression of the heterogeneous waste, and a second position for opening the aperture for the extraction of the solid phase from the pressing chamber, comprising means for horizontal movement of the movable component in the direction of the axis of the pressing chamber in order to apply the face of the movable component facing the outlet aperture of the pressing chamber against the outlet aperture during the compression of the heterogeneous waste.

According to other characteristics:

the movable component is formed by a sliding block controlled by a jack and guided by slides integral with the frame, the means for horizontal movement are formed by at least one jack integrated into the sliding block, whereof the piston moves in a direction parallel with the axis of the pressing chamber and bears against the wall of the discharge chamber opposite to the outlet orifice of the pressing chamber, the piston of the or of each jack is mounted in a bore one end of which opens onto the face of the sliding block opposite to the face facing the outlet orifice of the pressing chamber, and the other end which is delimited by a bottom, the bore being made in the sliding block, the piston is shorter than the bore in order to form a working chamber of the corresponding jack, through the piston of the or of each jack passes a bolt comprising a first step bearing against the lateral face of the piston, opposite to the lateral face intended to enter into contact with the wall of the discharge chamber and a second step bearing against a resilient component for return of the piston, the return component itself bearing against a collar mounted in the corresponding bore, the collar divides the working chamber into a main chamber and a secondary chamber, the chambers communicating with one another via at least one aperture provided in the collar, the sliding block comprises a single distribution channel in order simultaneously to supply with fluid under pressure the working chambers of the jack or jacks, and the means for horizontal movement are formed by a flat piston sliding in a jacket formed by the sliding block.

BRIEF DESCRIPTION OF THE DRAWINGS

Other characteristics and advantages of the invention will appear in the course of the following description, made with reference to the attached drawings which show several embodiments of the invention by way of example, and in which.

DESCRIPTION OF PREFERRED EMBODIMENTS

Figure 1:
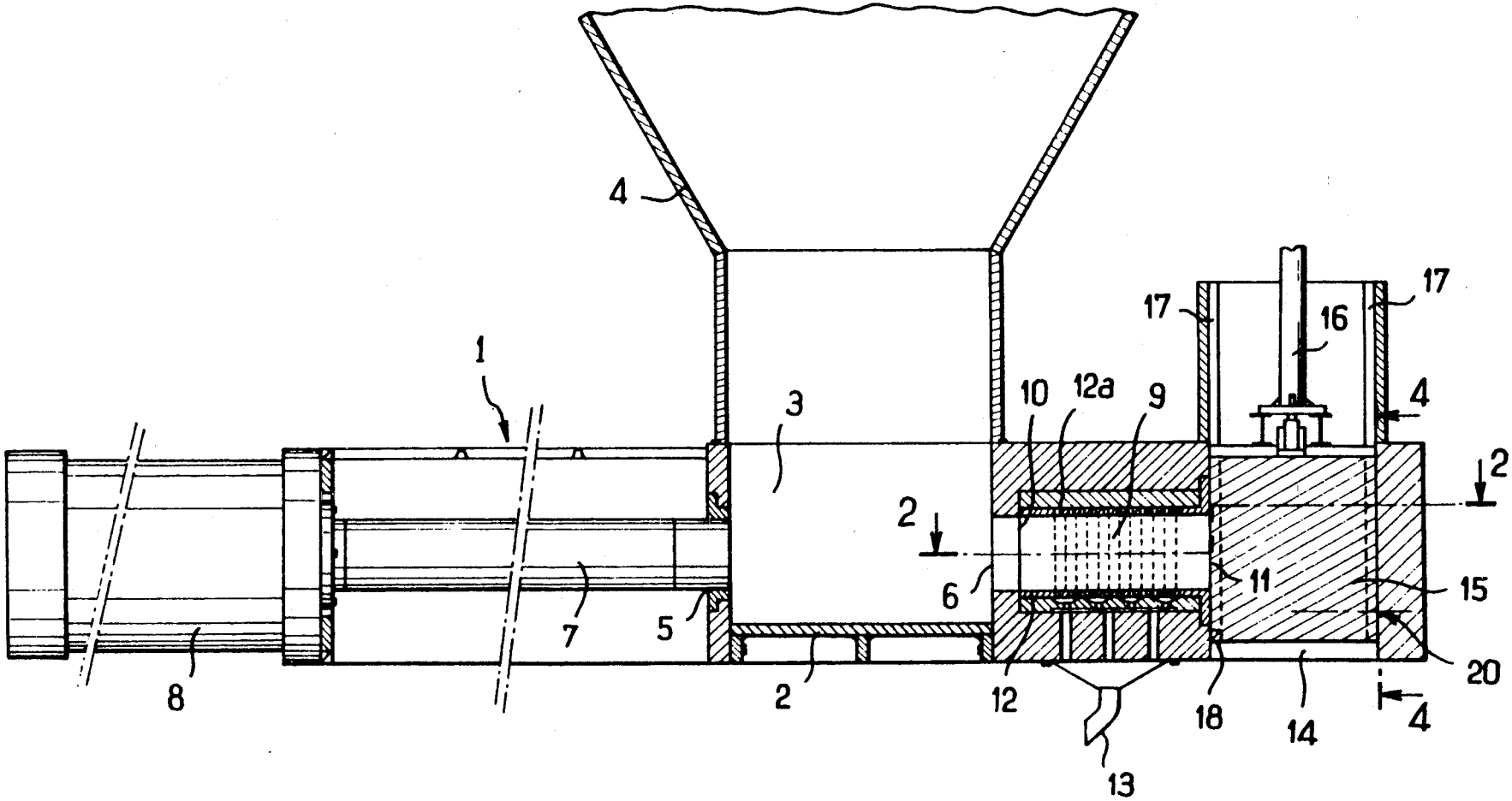
FIG. 1 is a schematic longitudinal section view of a press constructed according to the invention.

The press shown in FIG. 1 comprises a frame 1 supporting a receptacle 2 forming a zone 3 for feeding of the heterogeneous waste.

To this end, the feed zone 3 is open towards the top and surmounted by a hopper 4 fitted with at least one (ram (not shown) enabling the introduction of the waste into feed zone 3.

The feed zone 3 has two opposed lateral openings 5 and 6 with a cross-section adapted to that of a compression piston 7 of a jack 8, for example hydraulic, supported by the frame 1.

The piston 7 is movable between the opening 5 and a piston situated beyond the other opening 6 of the feed zone 3.

The opening 6 of the feed zone 3 opens into an annular pressing chamber 9 coaxial with feed zone 3 and with a cross-section equal to that of the piston 7.

This pressing chamber 9 comprises two opposed lateral openings 10 and 11.

The pressing chamber 9 comprises an internal jacket 12 pierced by a multitude of small calibrated passages **12*a* placing the interior of the pressing chamber 9 in communication with means for recovering the liquid phase through the intermediary of a channel 13**.

The pressing chamber 9 communicates via the outlet opening 11 with a chamber 14 for evacuating the solid phase of the waste.

The jacket 12 of the pressing chamber 9 is fitted on the side of the outlet aperture 11 with an annular collar **12*b* (FIG. 2**) forming a continuous external contact surface.

In this discharge chamber 14 is mounted a component movable transversely to the axis of the pressing chamber 9.

Figure 2:
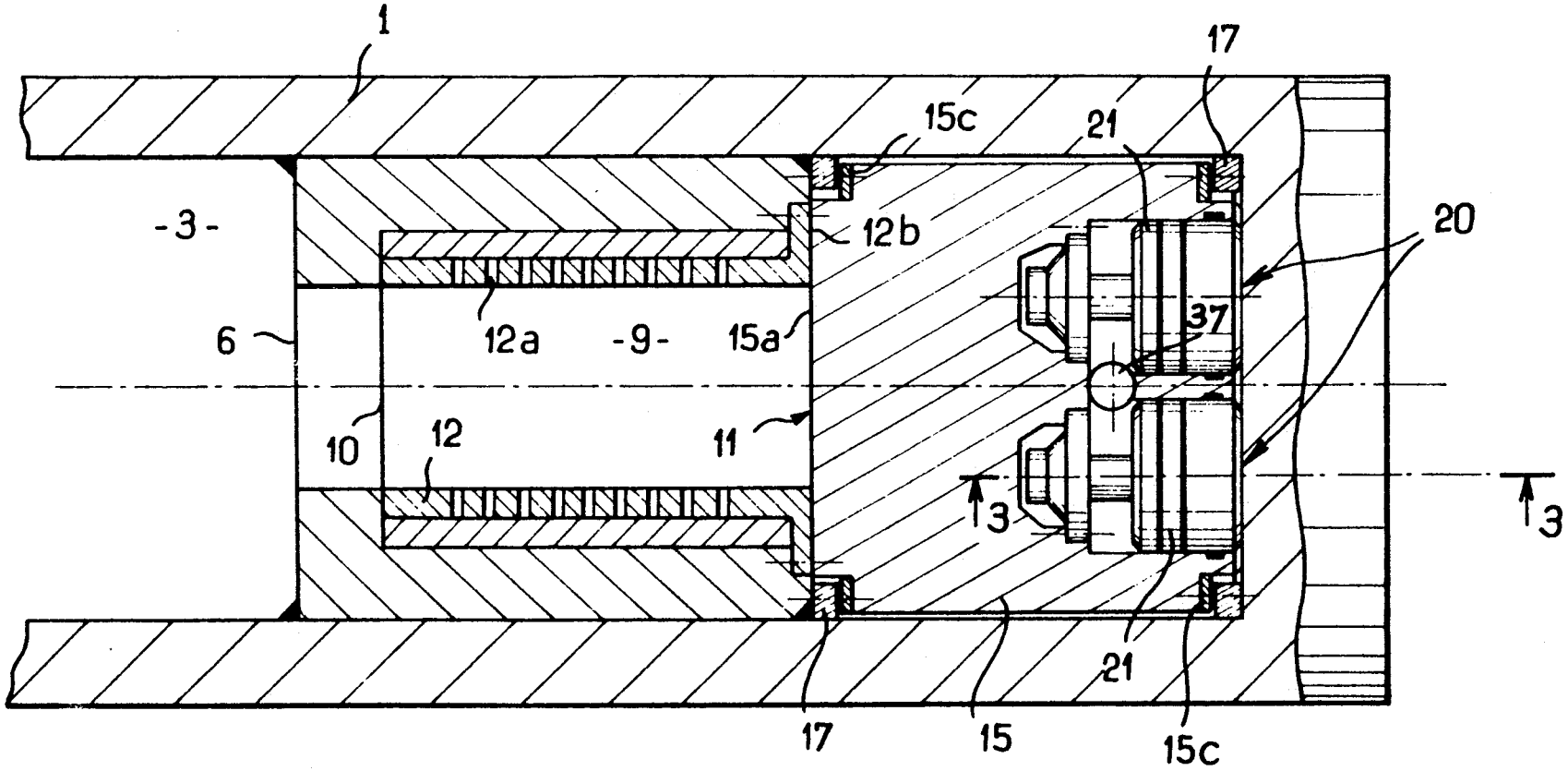
FIG. 2 is a sectional plan view on a larger scale along line 2—2 of FIG. 1.

This movable component is constituted by a sliding block 15 of parallelepipedic shape complementary to the discharge chamber 14 (FIGS. 1 and 2).

The sliding block 15 moves under the action of a jack 16, for example hydraulic, between a first position sealing the outlet aperture 11 of the pressing chamber 9 and a second position opening aperture 11.

During its movement, the sliding block 15 is guided by slides 17 integral with the frame 1.

To this end, the angles of the vertical edges of the sliding block 15 are cut away in the form of a square the faces of which are provided with guide strips **15*c* (FIG. 2) cooperating with the slides 17**.

A clearance is provided between the sliding block 15 and the slides 17 in order to allow lateral displacement of the sliding block against the outlet aperture 11 of the pressing chamber 9.

Furthermore, the sliding block 15 comprises, at the lower part of its faces in contact with the walls of the discharge chamber 14, cutters 18 serving to clean the walls of the chamber during the movement of the sliding block.

In the sliding block 15 are arranged means for horizontal movement of the sliding block in the direction of the axis of the pressing chamber 9 in order to apply the face **15*a* of the sliding block 15 against the annular collar 12*b* of the aperture 11 of the pressing chamber 9** during the compression of the heterogeneous waste.

Figure 4:
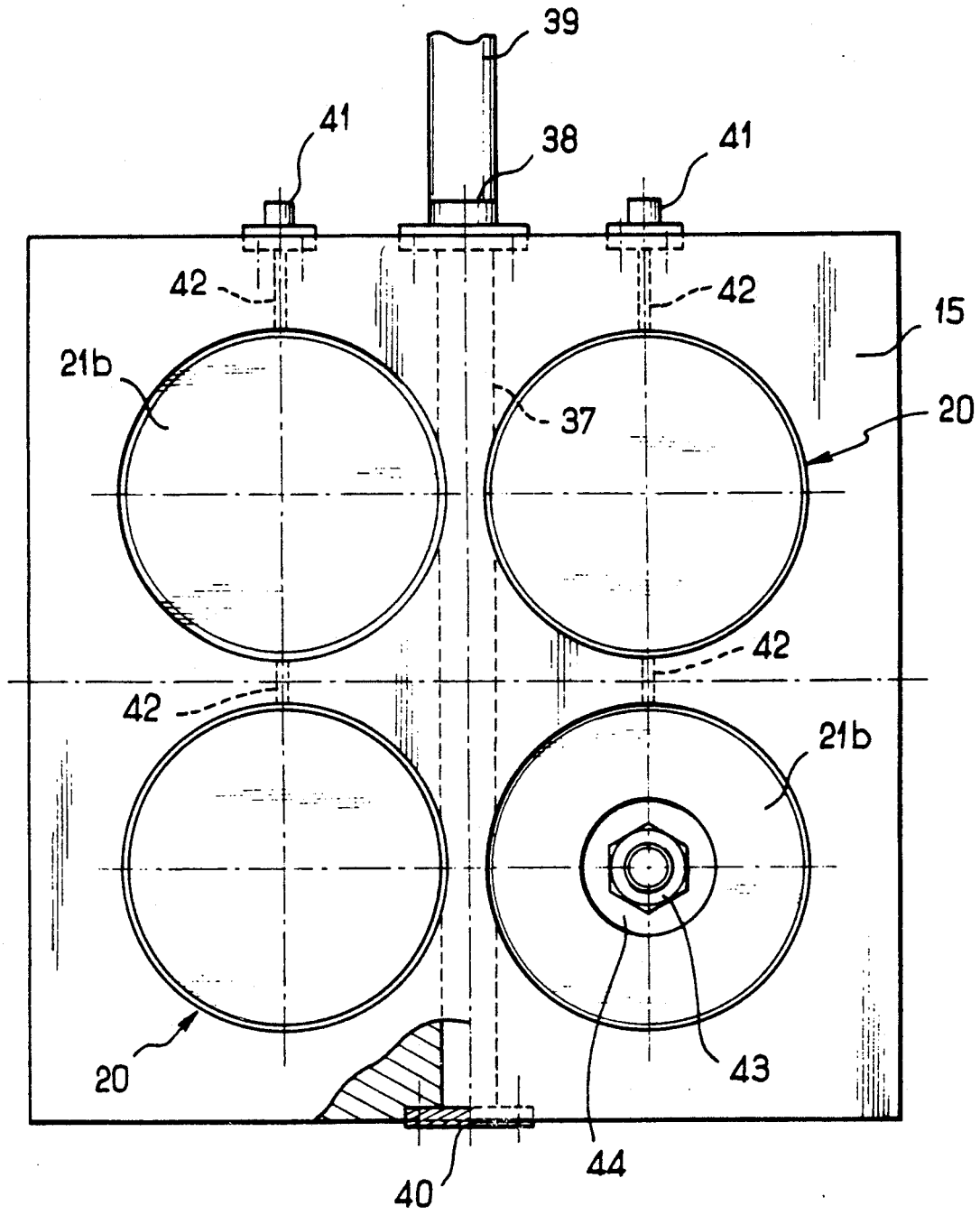
FIG. 4 is a sectional view along line 4—4 of FIG. 1, FIGS. 5 to 7 are schematic sectional views showing the various stages of operation of the press according to the invention.

These means for horizontal movement are constituted, for example, by four jacks 20 integrated into the sliding block 15 (FIG. 4).

Each jack 20 comprises a piston 21 movable in a direction parallel with the pressing chamber 9.

Figure 3:
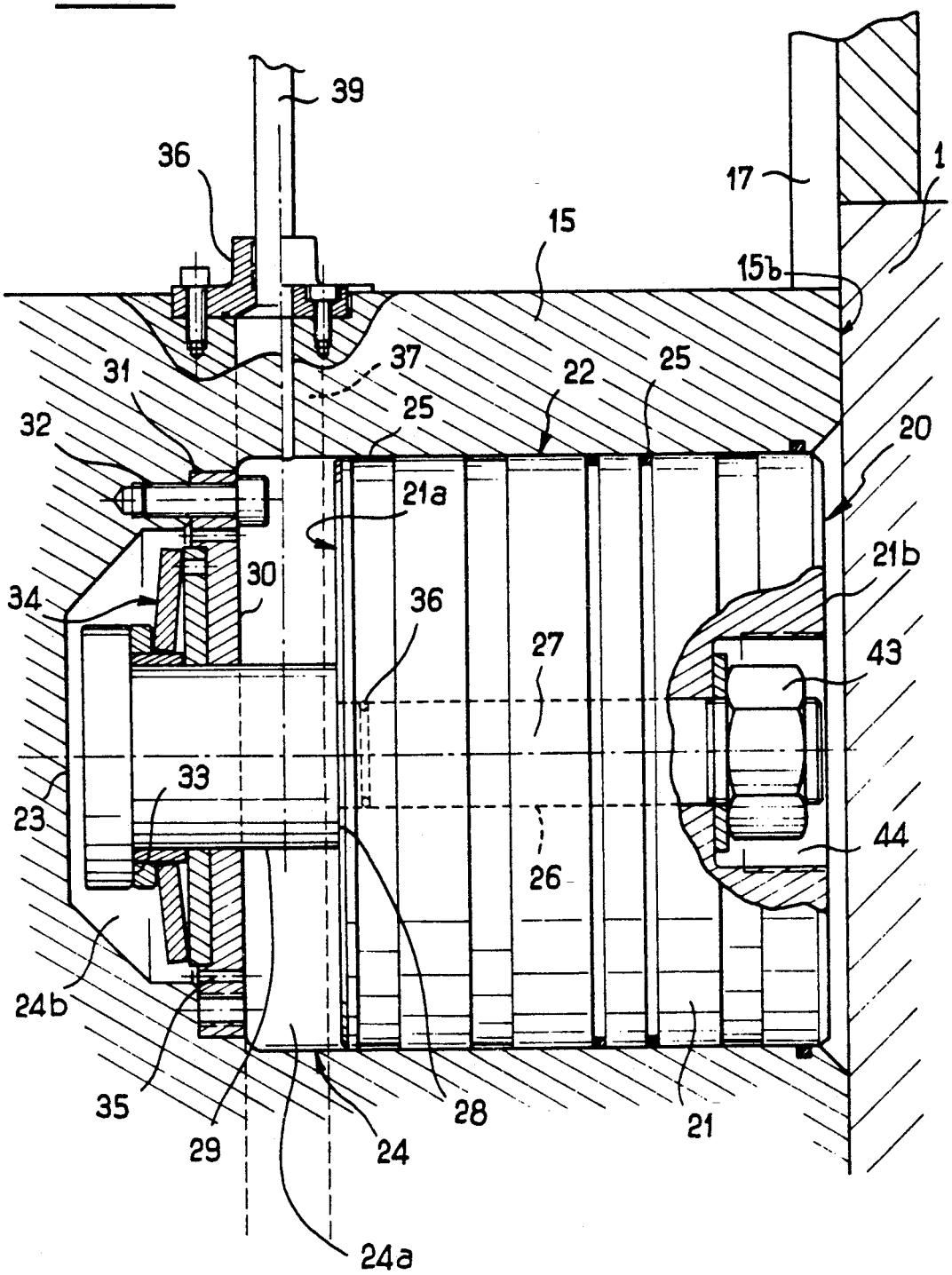
FIG. 3 is a sectional view along line 3—3 of FIG. 2.

As shown in greater detail in FIG. 3, the piston 21 of each jack 20 is mounted in a bore 22 one end of which opens onto the face **15*b* of the sliding block 15 opposite the face 15*a* facing the outlet aperture 11 of the pressing chamber 9, and the other end which is delimited by a bottom 23**.

The piston 21 is shorter than bore 22 so as to form a working chamber 24 and comprises on its external periphery conventional sealing means 25.

Furthermore, through the piston 21 passes an open-ended bore 26 in which is mounted a bolt 27 comprising a first step 28 intended to bear against the lateral face **21*a* of the piston 21**.

The cylindrical part 29 of step 28 is slideably mounted in a central bore in a collar 30 housed in a recess 31 provided in the bore 22.

Collar 30 is held, for example, by screws 32 distributed on a circumference in a symmetrical manner.

In the extension of the cylindrical part 29 of the first step 28, the bolt 27 comprises a second step 33 having an annular cross-section concentric with the annular cross-section of the first step 28.

The space between the second step 33 and the face of the collar 30, located face-to-face, is filled by a resilient component for return of the piston 21.

This resilient return component is constituted, for example, by Belleville washers 34.

The collar 30 divides the working chamber 24 into a main chamber **24*a* and into a secondary chamber 24*b*, the two chambers 24*a* and 24*b* communicating with one another via at least one aperture 35 in collar 30**.

This arrangement enables the driving fluid to act on the equivalent of the dynamic section of the piston 21.

The leaktightness of the working chamber 24 to the outside, passing through the bore 26, is ensured, for example, by an O-ring 36 housed in an adequate groove in the bolt 27.

Fluid under pressure is supplied to the working chambers 24 of the set of jacks 20 via a central duct 37 passing through the entire height of the sliding block 15 and positioned along the axis of symmetry of the distribution of jacks 20.

This central duct 37, taking into account its diameter of its position secant to the main chambers 24*a* of the jacks 20, ensures simultaneous distribution of the fluid under pressure into the various chambers.

The central duct 37 is connected by a threaded connection 38 screwed onto the upper face of the sliding block 15 to a pipe 39 for supplying fluid under pressure.

A drain plug 40 is provided in the lower part of the central duct 37.

On the upper face of the sliding block 15 are also provided two bleed plugs 41 which communicate, via ducts 42, with the working chambers 24 of the jacks 20 arranged in the same vertical plane.

The Belleville washers 34 are fitted and kept unstressed through the intermediary of a retaining nut 43 screwed onto the threaded end of the bolt 27 located opposite the second step 33.

The nut 43 is housed in a countersink 44 dimensioned so as to fully conceal nut 43 inside the piston 21.

The operation of the press described above is as follows:

Heterogeneous waste to be treated is introduced into the hopper 4 and pushed into the feed zone 3, for example by a ram (not shown).

At the start of the treatment cycle, to allow the introduction of the waste into the feed zone 3, the piston 7 is in the disengaged position shown in FIG. 1.

The sliding block 15 is, under the action of the jack 16, placed in a low position facing the outlet aperture 11 of the pressing chamber 9.

The fluid under pressure is admitted via the flexible pipe 39 and the central duct 37 into the main chambers 24*a* through the apertures 35 into the secondary chambers 24*b* of the set of jacks 20.

Figure 5:
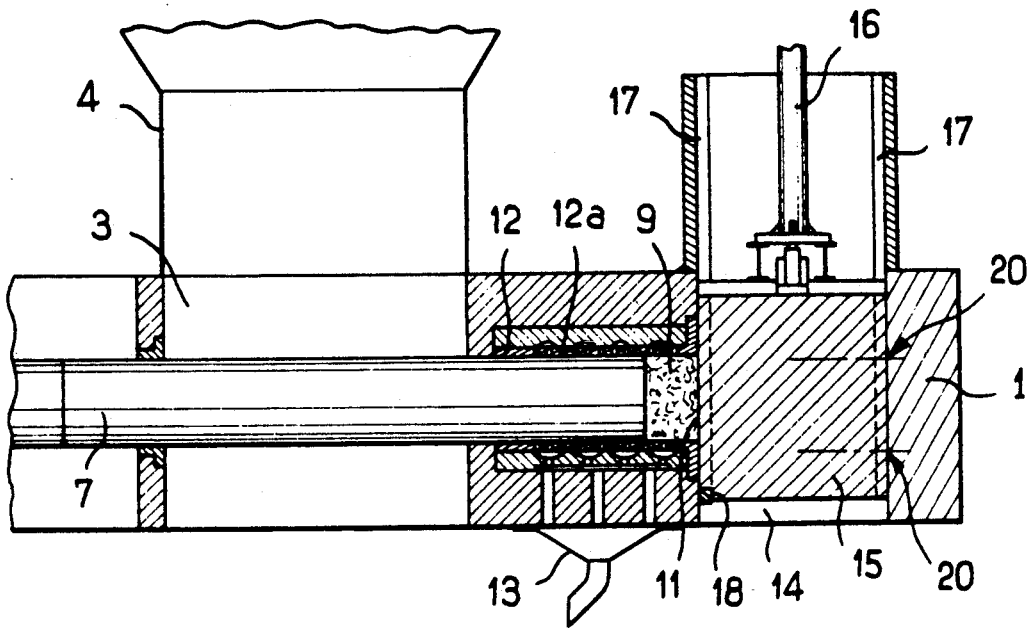

The pistons 21 move in a direction parallel with the axis of the pressing chamber 9, and piston faces 21*b* enter into contact with the wall of the discharge chamber 14 situated opposite to the outlet aperture 11. This causes compression of the Belleville washers 34 and, by reaction, the lateral movement of the sliding block 15 so that is face 15*a* directed towards the outlet aperture 11 comes to press against the outer face of the collar 12*b* and thus seals the outlet aperture 11 (FIGS. 2 and 5).

The seal at the aperture 11 is a seal of the metal-metal type, owing to the quality of the surfaces in contact and to the flattening force exerted by the pistons 21 of the jacks 20.

Next, the piston 7 controlled by the jack 8 moves towards the pressing chamber 9, pushing the waste contained in the feed zone 3 before it.

Continuing its advance, piston 7 pushes the waste into the pressing chamber 9 until a high pressure is obtained, and compresses it in the latter against the sliding block 15.

During the compression of the waste in the pressing chamber 9, the liquid phase is expressed from the raw waste and is discharged via the channel 13 through the calibrated passages 12*a* in the jacket 12 (FIG. 5).

When pressing of the waste is completed, the supply of fluid under pressure is stopped and the pistons 21 of the jacks 20 are returned to their initial position under the effect of the return force exerted by the Belleville washers 34 of each jack, thus freeing the sliding block 15, and sliding block 15 is brought back up under the action of the jack 16 so as to free the outlet aperture 11 of the pressing chamber 9.

Figure 6:
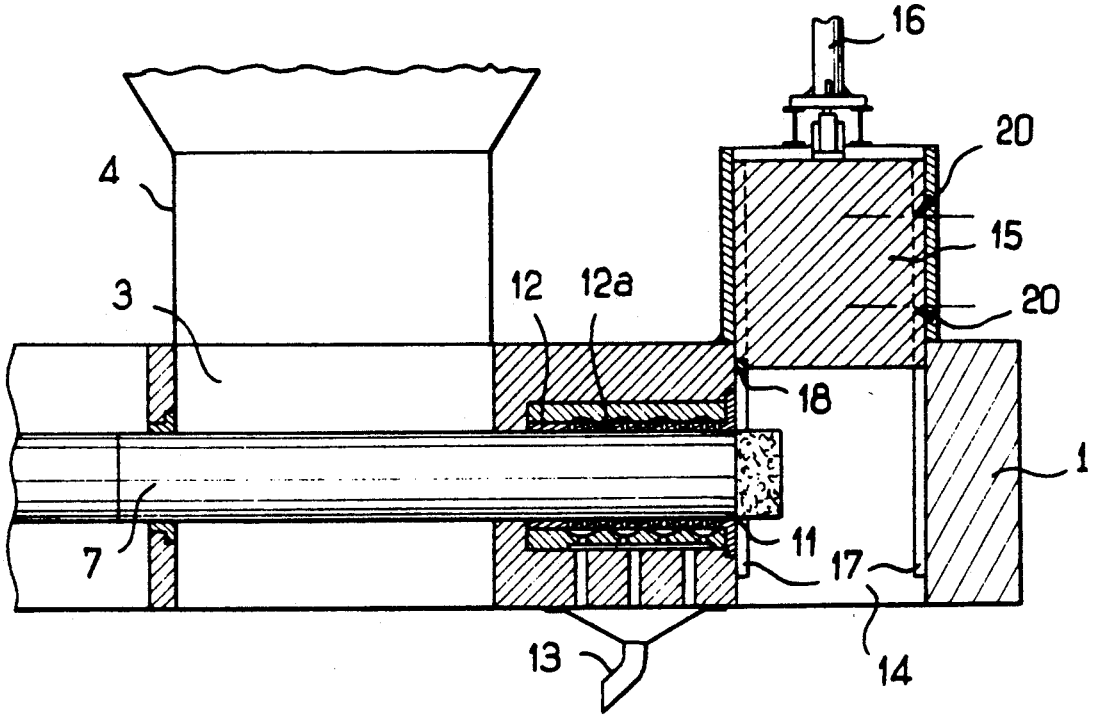
Figure 7:
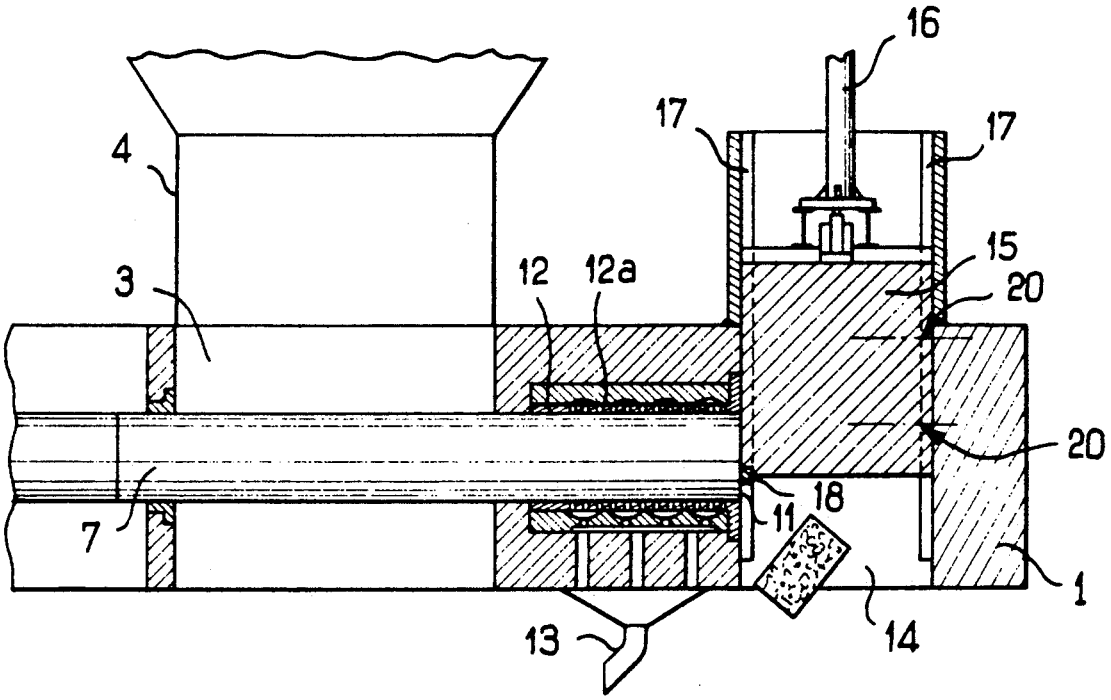

By advance of the piston 7 into the pressing chamber 9, the solid and dry parts of the waste are expelled from the pressing chamber (FIG. 6) and then, by the lowering of the sliding block 15, pushed into the discharge chamber 14 (FIG. 7).

Owing to the cutters 18, the sliding block 15 in its downward movement serves as a guillotine in case of jamming of the solid parts, and ensures the cleaning of the walls of the discharge chamber 14.

When the solid parts have been discharged, the piston 7 returns to its initial position for a new operating cycle similar to the preceding cycle.

Figure 8:
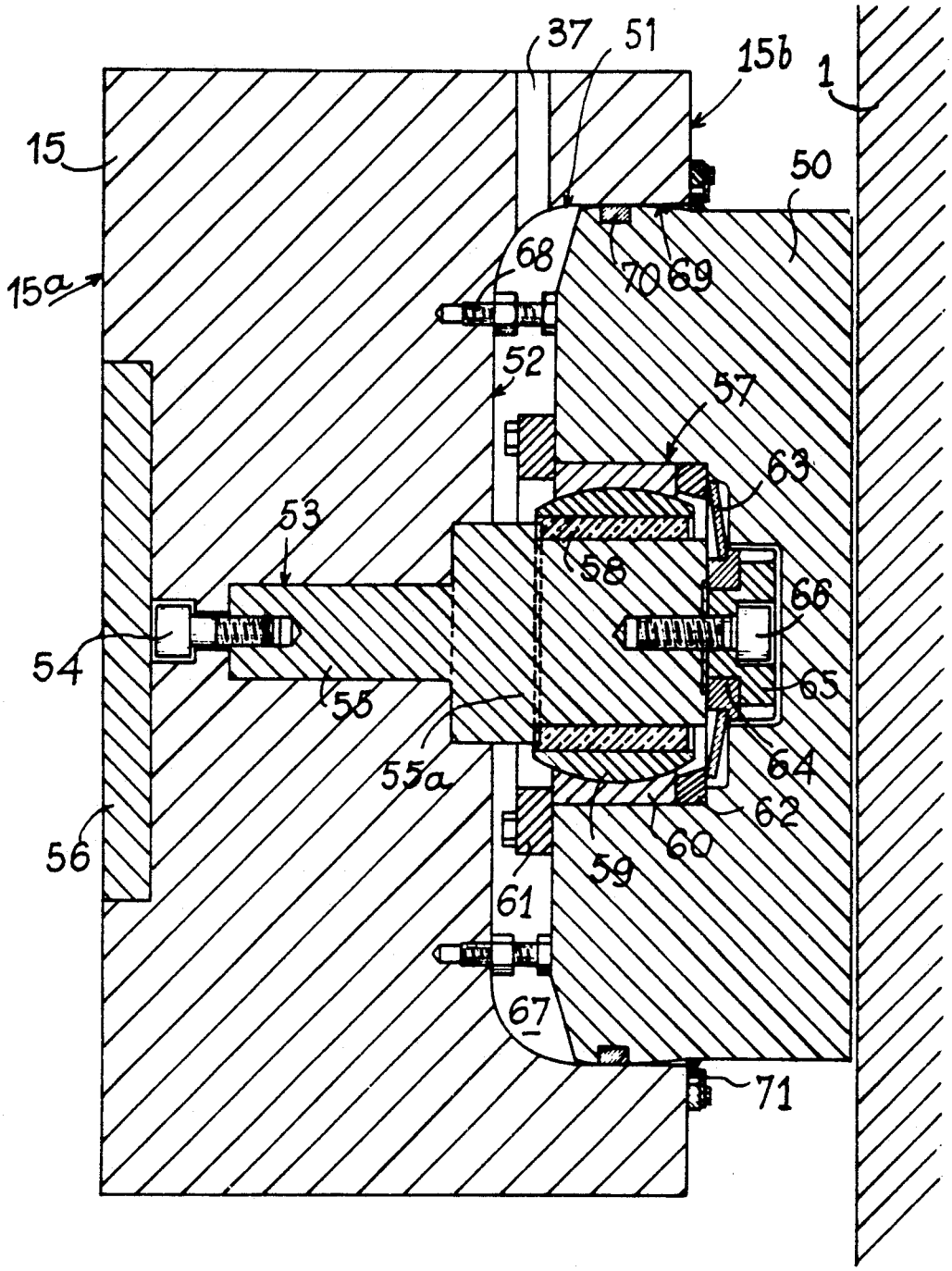
FIG. 8 is a sectional view of a variant of the means for moving the movable component for sealing the outlet aperture of the pressing chamber.

FIG. 8 shows a variant of the means for horizontal movement of the sliding block 15 in the direction of the axis of the pressing chamber 9 in order to apply the face 15*a* of the sliding block against the annular collar 12*b* of the aperture 11 of the pressing chamber 9 during the compression of the heterogeneous waste.

These means for horizontal movement of the sliding block 15 are constituted by a flat piston 50 sliding in a jacket formed by the sliding block 15 itself.

To this end, the flat piston 50 is slideably mounted in a bore 51 inside the sliding block 15, in the axis of the pressing chamber .

Bore 51 comprises one end which opens onto the face 15*b* of the sliding block 15, and an opposed end delimited by a bottom 52 into which opens a bore 53 of smaller diameter.

The bore 53 also opens onto the face 15*a* of the sliding block 15.

In bore 53 is mounted, by means of a screw 54, a shaft 55 which comprises a part 55*a* of greater diameter arranged in the bore 51.

The end of the bore 53 opening at the level of the face 15*a* of the sliding block 15 is closed off by a plate 56.

The piston 50 comprises an internal bore 57 of greater diameter than the part 55*a* of the shaft 55.

On this part 55*a* of the shaft 55 is mounted a sliding bush 58 on which is arranged a hemispherical element 59 which is intended to co-operate with another hemispherical element 60 of complementary shape, fixed into the bore 57 of the piston 50.

The two hemispherical elements 59 and 60 therefore form a ball joint.

The hemispherical element 60 is held in the bore 57, on one side, by a collar 61 and, on the other side, by a spacer 62 against which is applied a spring washer 63.

The spring washer 63 is mounted on a spacer 64 held on the end of the shaft 55 by a locking collar 65 and a screw 66.

The piston 50 forms with the bottom 52 of the bore 51 a working chamber 67 at the level of which emerges the duct 37 for the supply of fluid under pressure.

In order to limit the stroke of the piston 50 towards the bottom of the chamber 67, under the effect of the spring washer 64, adjustable stops 68 are provided in this chamber.

Furthermore, the zone of contact 69 between the piston 50 and the bore 51 is formed by a hemispherical bearing surface comprising a seal 70. The leaktightness is augmented by a scraper seal 71 fixed to the face 15*b* of the sliding block 15, which comes to be applied against the lateral face of the piston 50.

This variant functions in the same manner as the preceding embodiment, with a single piston placed in the axis of the pressing chamber 9, the piston being capable of oscillating slightly owing to the hemispherical elements 59 and 60 and to the hemispherical bearing surface 69.

This system has the advantage that it can be used to close off the outlet aperture of the pressing chamber through the intermediary of the sliding block, at least one jack being integrated into the sliding block and having a small stroke, of the order of 5 mm, whereof the oil capacity is reduced, thus enabling a faster response time to be obtained and the speeds of treatment of the waste to be increased.

It also has the advantage of not requiring sealing components at the level of the outlet aperture of the pressing chamber which, as is known, are components which deteriorate rapidly and thus require frequent replacement.

I claim:

1. Press for compacting and treatment of heterogeneous waste comprising a solid phase and a liquid phase, said press comprising (a) a frame;

(b) a feed zone receiving heterogeneous waste to be treated, said feed zone having an open top and first and second opposed lateral openings with a cross-section adapted to a cross-section of a compression piston movable between said first opening and a position situated beyond said second opening;

(c) a pressing chamber comprising an intake aperture and an outlet aperture, said pressing chamber being opposed and arranged coaxially with respect to said feed zone and having a cross-section substantially equal to said cross-section of said compression piston and comprising calibrated passages connecting said pressing chamber to means for recovery of said liquid phase;

(d) a chamber of discharging said solid phase located downstream of said pressing chamber;

(e) sliding block controlled by a jack and guided by slides integral with said frame movable transversely with respect to an axis of said pressing chamber between a first position sealing said outlet aperture of said pressing chamber during compression of said heterogeneous waste and a second position opening said outlet aperture for extraction of said solid phase from said pressing chamber and comprising means for horizontal movement of said movable component in a direction of said axis of said pressing chamber to apply a first face of said movable component facing said outlet aperture of said pressing chamber against said outlet aperture during compression of said heterogeneous waste, said means for horizontal movement being constituted by at least one jack integrated into said sliding block, said jacking having a piston which moves in a direction parallel with said axis of said pressing chamber and bears against a wall of said discharge chamber opposite to said outlet aperture of said pressing chamber.

2. Press according to claim 1, wherein said piston of said jack is mounted in a bore having a first end opening onto a second face of said sliding block opposite said first face facing said outlet aperture of said pressing chamber and a second end delimited by a bottom, said bore being located in said sliding block.

3. Press according to claim 1, wherein said piston is shorter than said bore so as to form a working chamber of a corresponding jack.

4. Press according to claim 1, wherein said piston contains a bolt comprising a first step bearing against a first lateral face of said piston opposite to a second lateral face of said piston intended to contact a wall of said discharge chamber and a second step bearing against a resilient component for return of said piston, said return component itself bearing against a collar mounted in said corresponding bore.

5. Press according to claim 4, wherein said collar divides said working chamber into a main chamber and a secondary chamber communicating with one another via at least one aperture provided in said collar.

6. Press according to claim 1, comprising a plurality of jacks, wherein said sliding block comprises a single distribution channel simultaneously supplying fluid under pressure to chambers of said jacks.

7. Press according to claim 1, wherein said means for horizontal movement are constituted by a flat piston sliding in a jacket formed by said sliding block.

8. Press according to claim 1, wherein the sliding block comprises a single distribution channel in order simultaneously to supply with fluid under pressure the chambers of the at least one jack.

9. Press according to claim 1, wherein means for horizontal movement are formed by a flat piston sliding in a jacket formed by the sliding block.

* * * * *